United States Patent [19]

Linder

[11] 4,281,524

[45] Aug. 4, 1981

[54] KEY-CONTROLLED LOCK FOR A BARRIER CABLE

[76] Inventor: Peter J. Linder, 3109 Ramblewood Rd., Ellicott City, Md. 21043

[21] Appl. No.: 118,963

[22] Filed: Feb. 5, 1980

[51] Int. Cl.[3] ..... E05B 73/00

[52] U.S. Cl. ..... 70/18; 49/34; 70/371; 70/DIG. 57

[58] Field of Search ..... 49/34; 70/18, 371, 417, 70/DIG. 57

[56] References Cited

U.S. PATENT DOCUMENTS

| | | | |
|---|---|---|---|
| 1,331,778 | 2/1920 | Michell . | |
| 3,435,642 | 4/1969 | Del Pesco . | |
| 3,637,180 | 1/1972 | Parry | 70/371 |
| 3,990,182 | 11/1976 | Linder | 49/34 |
| 4,028,916 | 6/1977 | Pender . | |
| 4,033,160 | 7/1977 | Mima . | |
| 4,055,973 | 11/1977 | Best . | |
| 4,075,878 | 2/1978 | Best . | |
| 4,086,795 | 5/1978 | Foster . | |

*Primary Examiner*—Robert L. Wolfe

*Attorney, Agent, or Firm*—Browdy and Neimark

[57] ABSTRACT

A cable lock for one end of a barrier cable of the type suspended between a pair of spaced upstanding supports, wherein one end of the cable is permanently secured to one support and the other end is detachably secured to the second support. The second support is cut away at its top end to define a step, and a main lock body is secured to the vertical wall of the step, spaced above the horizontal wall of said step. A metal plate is secured to the vertical wall between the lock body and said vertical wall. The plate has an opening registering with the cable bore of the second support. The lock body has an enlarged recess defining an inside top shoulder at the plate. The cable has an enlarged ferrule receivable in the recess via the cable bore and the registering opening of the plate. The ferrule is clamped in an elevated position in the recess to lockingly interengage with said inside shoulder by a vertical Acme-treaded clamping Allen screw in the lock body. Below the clamping screw the lock body contains a cylinder lock with a key-releasable center plug which normally blocks access to the Allen screw from below. When the proper key is employed, the center plug drops out, allowing access to the Allen screw for unscrewing it and lowering the cable ferrule so that the cable can be disengaged from the second support.

15 Claims, 6 Drawing Figures

KEY-CONTROLLED LOCK FOR A BARRIER CABLE

FIELD OF INVENTION

This invention relates to barrier cable locking devices, and more particularly to barrier cable locking devices of the key-controlled type wherein one end of a cable is detachably connected to an upstanding support and cannot be detached without the employment of the proper key.

BACKGROUND OF THE INVENTION

Various types of vehicle-blocking barrier cable arrangements of the key-controlled type have been employed to control the entry of vehicles into parking enclosures, or the like; or to control the passage of vehicles to restricted areas within parks, recreational areas, etc. or to other locations where it is desired to prevent entry of unauthorized vehicles.

Prior to the device of the Linder U.S. Pat. No. 3,990,182, the locking devices employed with such barrier cables consisted largely of arrangements employing padlocks, or the like, requiring protection from the weather, and usually consisting of cumbersome and relatively expensive parts, being subject to rapid deterioration, being expensive to fabricate and install, being vulnerable to tampering and theft, being subject to mechanical failure, and being difficult to operate. Even the device of Linder '182, which successfully solved many of the prior problems, continues to rely on the presence of a padlock, and therefore has the problems inherent in the use of a padlock. Thus, there is a substantial need for a relatively simple and compact cable locking device which can be easily locked and unlocked by an authorized person but which cannot be readily unlocked without a proper key.

A preliminary search of the patent literature revealed the following prior U.S. Pats. of interest:

Michell, No. 1,331,778
Del Pesco, No. 3,435,642
Pender, No. 4,028,916
Mima, No. 4,033,160
Best, No. 4,055,973
Best, No. 4,075,878
Foster et al, No. 4,086,795

SUMMARY OF THE INVENTION

Accordingly, an object of the invention is to overcome the deficiencies and disadvantages of the cable locking devices previously employed; another object is to provide an improved barrier cable locking device; yet another object is to provide such a locking device which is not reliant on a padlock; a further object is to provide a cable locking device which is smaller and therefore causes less damage when installed on a live tree, is easier to install, and is stronger.

A further object of the invention is to provide an improved barrier cable locking device which is simple in construction, which involves the use of relatively inexpensive parts, which is easy to install, which is compact in size, and which is effectively protected both from weather conditions and from tampering and theft.

A still further object of the invention is to provide an improved barrier cable locking device which can be easily installed on an upstanding vertical support, such as a post, tree, or other upstanding object, requiring only a small modification of the upstanding object for such installation, which is neat in appearance, which is durable in construction, and which can be readily adapted for use with existing posts of various types.

A still further object of the invention is to provide an improved barrier cable locking device which can be fabricated from readily available parts, which can be easily operated by an authorized person with a proper key, by means of a simple tool, such as an Allen wrench, or the like, and which cannot be unlocked except by use of the proper key.

BRIEF DESCRIPTION OF THE DRAWINGS

Further objects and advantages of the invention will become apparent from the following description and claims, and from the accompanying drawings, wherein:

DESCRIPTION OF A PREFERRED EMBODIMENT

Figure 1:
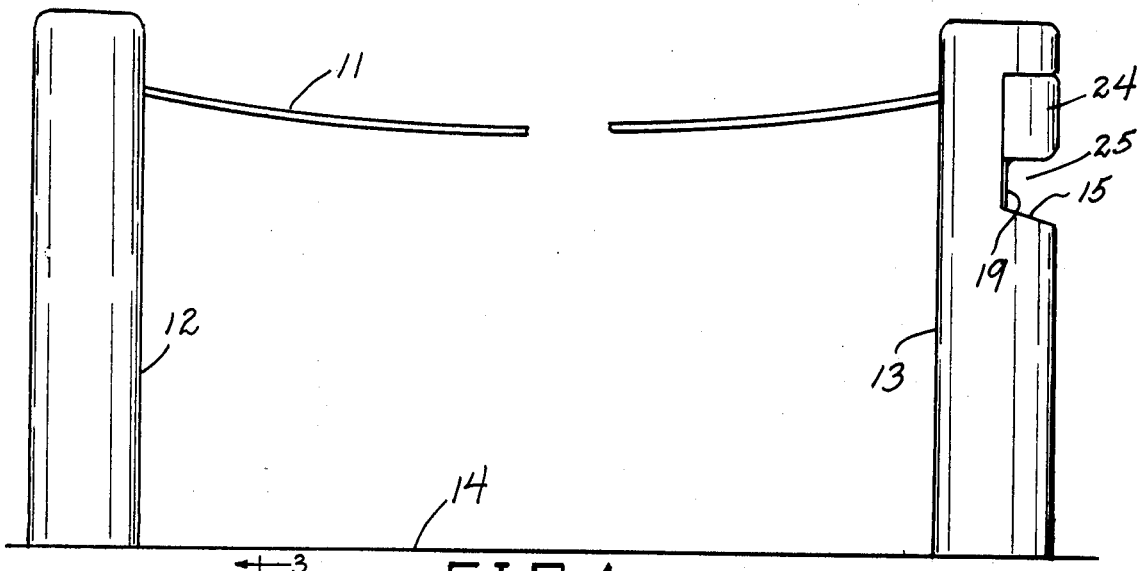
FIG. 1 is a front elevational view, partly broken away, of a typical barrier cable installation employing a cable locking device according to the present invention.

Referring to the drawings, FIG. 1 shows a typical barrier cable installation wherein a cable 11 is permanently secured at one end to a first upstanding post member 12 and is releasably secured at its other end to a second upstanding post member 13, said post members 12 and 13 being located on opposite sides of a roadway or other passageway 14 leading to an area or enclosure of a restricted nature, such as a parking lot, a recreational area, or other location or enclosure requiring restriction of entry or traversal by a motor vehicle. See Linder U.S. Pat. No. 3,990,182.

The post members 12 and 13 are of conventional material, such as wood, metal, or other suitable material, and are permanently and rigidly embedded in the ground. Said post members may have any suitable cross-sectional shape, being shown herein merely by way of example, as being substantially circular in cross-section.

Figure 2:
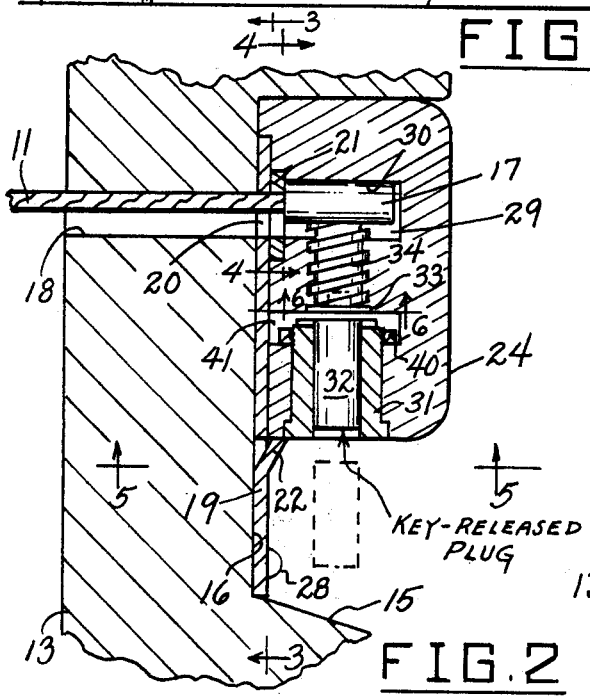
FIG. 2 is an enlarged vertical cross-sectional view taken through the cable locking device of FIG. 1.

As shown in FIGS. 1 and 2, the second post member 13 is recessed on the side thereof remote from the first post member 12, to define a notch having a bottom wall 15 which is preferably sloped as shown or which may be horizontal, and a vertical wall 16. Where the post member 13 is circular in cross-section, as shown herein, the vertical wall 16 may be located in a diametral plane, although other locations of the vertical wall 16 may be employed within the spirit of the present invention.

Figure 3:
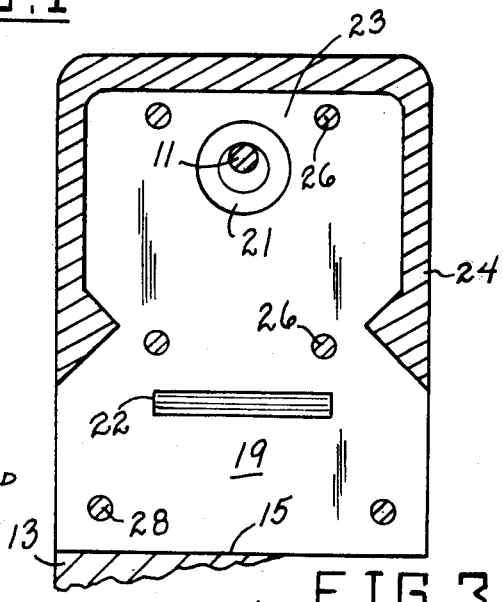
FIG. 3 is a transverse vertical cross-sectional view taken substantially on line 3—3 of FIG. 2.

The cable 11 is provided with an enlarged cylindrical end ferrule 17 and the top end portion of post member 13 is formed with a horizontal bore 18 of sufficient diameter to allow ferrule 17 to easily slide therethrough. A metal plate member 19 is mounted adjacent to the vertical wall 16 and has a circular aperture 20 registering with bore 18. The circular aperture 20 is provided coaxially with an outer hardened steel bearing washer 21 rigidly secured, such as by welding, epoxy resin or cyanoacrylate adhesive (e.g. Superglue) or other suitable fastening means, to the plate member 19, itself preferably formed of hardened steel or high tensile aluminum. Also rigidly secured to or preferably stamped into the plate member 19 is an elongated horizontal shelf member 22, spaced below the washer 21, as shown in FIGS. 2 and 3, the shelf member 22 having a generally triangular cross-sectional shape.

The plate member 19 is formed to define an upper head portion 23 of reduced width as compared with the diametral width of the post member 13, and a lower portion which is of the substantially equal width of the recess in the post 13 or tree in which the recess is cut.

A generally semi-cylindrical main lock body 14, preferably a steel or aluminum casting, is shaped to engage on shelf member 22 and to fit closely over the reduced upper portion of the plate member 19, the body 24 having an outside contour such as to merge smoothly with that of the post member 13 and to leave an access space 25 between the substantially flat bottom of lock body 24 and the bottom wall 15. The body 24 is preferably permanently and rigidly pre-secured, before installation, in interfitting overlying relationship to the upper portion of the plate member by suitable non-removable fastening means, such as epoxy adhesive or the like, or welding, or by screws. A plurality of nonremovable, long, headed nails, bolts or screws 26 are engaged through counterbored holes 27 in the main body 24 and registering holes in the plate member, and are rigidly anchored and embedded in the post member 13 during installation. Similar fastening nails, screws, or bolts 28 may be employed to rigidly secure the lower portion of plate member 19 to the vertical step wall 16 of the post 13.

Figure 4:
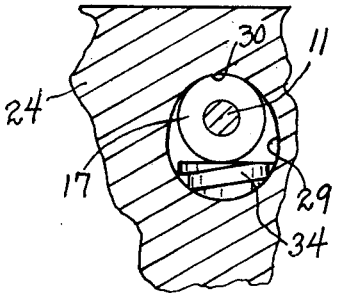
FIG. 4 is an enlarged fragmentary vertical cross-sectional view taken substantially on line 4—4 of FIG. 2.
Figure 6:
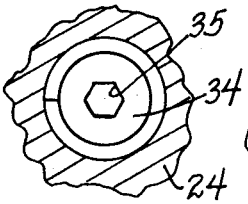
FIG. 6 is an enlarged fragmentary horizontal cross-sectional view taken substantially on line 6—6 of FIG. 2.

The upper portion of the main lock body 24 is formed with a horizontally extending cavity or recess 29 communicating with the central aperture of the washer 21 but having a top wall section 30 offset upwardly with respect to the washer aperture to define an inside top shoulder lockingly engageable by the ferrule 17 when it is pushed upwardly to engage the top wall 30, namely to the position shown in FIGS. 2 and 4. As shown in FIG. 4, the recess 29 may be substantially vertically egg-shaped in cross-section so that the ferrule 17 is gripped against the cavity top wall 30 in more than one spot, under locking conditions as described below, to inhibit movement of the ferrule 17.

Mounted in the lower portion of block 24 substantially in vertical alignment with the cavity 29 is a conventional cylinder plug lock assembly comprising a vertical barrel sleeve member 31 rigidly and permanently secured in the bottom portion of the block 24, containing a key-releasable cylinder plug 32 which can be removed from the sleeve member 31 by using a proper key, thereby allowing the plug 32 to drop out of the sleeve member 31. Such a cylinder plug lock assembly may be similar to Model RPL-11 or RPL-21, manufactured by Fort Lock Corp., River Grove, Ill. The sleeve member 31 may suitably be held in place with a nut such as the hexagonal nut 40, access being provided through a back opening cavity 41.

Immediately above the cylinder plug lock assembly, the body 24 is provided with a thread-tapped passage 33 leading to the cavity 29, the passage 33 containing complementary threaded clamping screw 34 engageable beneath ferrule 17 when the ferrule has been received in the cavity 29. The passage 33 and screw 34 are suitably provided with Acme-type threads as illustrated. The bottom of the screw 34 has a hexagonal recess 35 adapted to receive an Allen wrench for rotating the screw. Alternatively, the bottom recess in the screw 34 may be square or may be of any other desired non-circular shape, to receive a correspondingly shaped rotating tool.

Access to the clamping screw 34 is obtained only when the key plug 32 is removed. Thus, to lock the cable 11 to the post member 13, the operator first removes the plug 32, using a proper key, then inserts the ferrule 17 through bore 18 and past washer 21 into recess 29, then inserts the rotating tool upwardly through the sleeve 31, then engages the tool in the non-circular recess 35 in the bottom of screw 34, and then rotates the tool so as to tightly clamp the ferrule 17 against the top wall portion 30 of recess 29. The tool is disengaged and the key plug 32 is then reinserted into sleeve 31 and locked.

To disengage the cable 11 from post member 13, the operator must first release the key plug 32 by means of a proper key and allow it to drop out of sleeve member 31, after which the clamping screw 34 may be unscrewed, by means of the required tool, to allow the ferrule 17 to descend sufficiently to clear the inside shoulder defined by the upper portion of washer 21. The ferrule can then be pulled through the bore 18. The key plug 32 may then be replaced in the sleeve member 31 until it is again necessary to attach cable 11 to post member 13.

The barrier cable 11 may be suspended between upstanding post members, as above described, or alternatively, between a pair of trees, one tree being employed for permanently securing one end of the cable and the other tree being suitably drilled and notched out for installation of the above-described locking device for releasably securing the remaining end of the cable, which, as above described, has an end ferrule 17 receivable in the recess 29 of the main body 24. The main body 24 is preferably formed of material with high resistance to weathering or corrosion, such as cast aluminum.

As shown in FIG. 2, the plate member 19 preferably extends downwardly substantially into supportive contact with the horizontal bottom wall 15.

Figure 5:
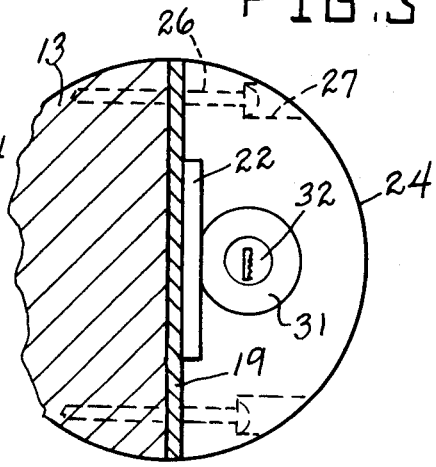
FIG. 5 is a fragmentary horizontal cross-sectional view taken substantially on line 5—5 of FIG. 2.

While a specific embodiment of an improved barrier cable locking device has been disclosed in the foregoing description, it will be understood that various modifications within the scope of the invention may occur to those skilled in the art. Therefore it is intended that adaptations and modifications should and are intended to be comprehended within the meaning and range of equivalents of the disclosed embodiment. For example, the washer 21 may be eliminated if the thickness of the backplate 19 is suitably increased and such backplate is formed of hardened steel. Also, alternative means can be used to releasably retain the ferrule 17 within the cavity 29, such as a hardened steel rack plate, grooved to receive the ferrule, and driven by a gearing mechanism. The main body 24 may assume a rectangular configuration as viewed from FIG. 5 to fit on or within a rectangular post 13, e.g. formed of steel.

What is claimed is:

1. In combination with a roadway, means defining a security barrier across said roadway, said barrier means comprising a first upstanding support at one side of the roadway, a second upstanding support at the opposite side of the roadway, a barrier cable extending across the roadway at barrier height, means permanently securing one end of said cable to the first upstanding support, said second upstanding support being formed at the side thereof remote from the first support to define a notch having a generally horizontal bottom wall and a generally vertical inner wall, a main lock body secured to said generally vertical inner wall and being located above said generally horizontal bottom wall to define an access space, said lock body being formed with a locking recess facing said inner wall, said second support being formed with a cable-receiving bore communicating with said locking recess, said other end of the cable having an enlarged end ferrule slidably fitting through said cable-receiving bore and being movable into said locking recess, the top wall of said recess being upwardly offset relative to said bore sufficiently to define an inside locking shoulder, a vertical clamping screw threadedly engaged in said lock body below the recess in a position to clamp the ferrule against said recess top wall, whereby to hold the ferrule in locking interengagement with said inside shoulder, and a cylinder lock assembly vertically mounted in the bottom of the lock body subjacent to and substantially in vertical alignment with said screw, said cylinder lock assembly including a central key-releasable cylinder plug normally blocking access to said clamping screw but being releasable responsive to actuation by a proper key to allow the plug to move downwardly into said access space to afford operating access from below to said clamping screw.

2. The structural combination of claim 1, and wherein said clamping screw is formed with Acme threads.

3. The structural combination of claim 1, and wherein a hardened metal annular bearing element is provided between said lock body and said vertical wall in registry with said cable-receiving bore, forming said inside locking shoulder.

4. The structural combination of claim 1, and a metal plate member interposed between said main lock body and said inner wall and having an aperture registering with said cable-receiving bore.

5. The structural combination of claim 4, and wherein a hardened steel bearing washer is secured coaxially around said aperture and forms said inside locking shoulder.

6. The structural combination of claim 1, and wherein the bottom end of said clamping screw is formed with a non-circular recess for interengagement with an actuating tool.

7. The structural combination of claim 1, and a metal plate member interposed between said main lock body and said inner wall and having an aperture registering with said cable-receiving bore, and wherein said plate member is provided with a projection supportingly engaged beneath the main lock body.

8. The structural combination of claim 7, and wherein said lock body has a substantially flat horizontal bottom surface, and wherein said projection comprises a horizontal rib element supportingly engaged beneath said horizontal bottom surface.

9. The structural combination of claim 1, and a metal plate member interposed between said main lock body and said inner wall and having an aperture registering with said cable-receiving bore, said plate member extending downwardly substantially into supportive contact with said generally horizontal bottom wall.

10. The structural combination of claim 9, and wherein said metal plate member has a top portion which is relatively reduced in width as compared with its lower portion and said main lock body is formed to interfit with said reduced top portion.

11. The structural combination of claim 10, and wherein the lower portion of the plate member is provided with a projection supportingly engaged beneath the main lock body.

12. The structural combination of claim 11, and wherein said main lock body has a substantially flat horizontal bottom surface and said projection comprises a horizontal rib of substantially triangular cross section.

13. In a device for entrance security across a roadway, comprising a steel cable for suspension across the roadway, and having first and second ends; connecting means at the first end of said cable to connect the first end of the cable to a first tree or post; and means to releasably lock and unlock the second end of the cable to a second tree or post with said cable passing through the second tree or post; the improvement wherein said means to lock and unlock the second end of the cable comprises:

an enlarged end ferrule on the second end of said cable and adapted to pass through the second tree or post;

a lock body for attachment to the second tree or post in a notch provided in the second tree or post on the far side thereof from the roadway, said lock body having a generally flat backplate adapted to contact a flat vertical wall of the notch and having a bore therethrough adapted to receive the second end of said cable with said end ferrule thereon, said lock body having a locking cavity facing said backplate, the top wall of said locking cavity being upwardly offset relative to the bore of said backplate sufficient to define an inside locking shoulder;

clamping means to clamp said ferrule in locking interengagement with said inside locking shoulder, said clamping means being within said lock body and being reversibly drivable from a lower non-clamping position to an upper clamping position; and a cylinder lock assembly vertically mounted in the bottom of said lock body below and in substantial vertical alignment to said clamping means, said cylinder lock assembly including a central key-releasable cylinder plug normally blocking access to said clamping means but being unlockable by a proper key to allow said cylinder plug to be withdrawn downwardly to afford access from below to said clamping means.

14. A device according to claim 13, wherein said clamping means comprises a vertically disposed Acme screw, the upper end of which abuts said ferrule in the locked mode; said screw having a non-circular shaped recess at its lower end for interengagement with a complementary shaped turning tool when said cylinder plug is removed.

15. A device according to claim 14, wherein the locking cavity of said lock body has a vertical cross-section in the shape of an egg with the narrow end at the top thereof.

* * * * *